United States Patent [19]

Trozzi

[11] 4,116,388

[45] Sep. 26, 1978

[54] BURNER NOZZLE

[75] Inventor: Norman Kenneth Trozzi, W. Caldwell, N.J.

[73] Assignee: Foster Wheeler Energy Corporation, Livingston, N.J.

[21] Appl. No.: 767,242

[22] Filed: Feb. 10, 1977

[51] Int. Cl.[2] ..... B05B 7/10

[52] U.S. Cl. ..... 239/406

[58] Field of Search ..... 239/406, 405, 404, 403, 239/474.5; 60/39.74

[56] References Cited

U.S. PATENT DOCUMENTS

| | | | |
|---|---|---|---|
| 2,567,485 | 9/1951 | Jenny | 239/406 |
| 3,116,017 | 12/1963 | Straw et al. | 239/406 |
| 3,360,201 | 12/1967 | Popyk | 239/406 |
| 3,361,182 | 1/1968 | Pillard | 239/406 |

*Primary Examiner*—James B. Marbert

*Attorney, Agent, or Firm*—Marvin A. Naigur; John E. Wilson; John J. Herguth, Jr.

[57] ABSTRACT

A burner nozzle for feeding the combustion zone of a vapor generator with a mixture of pulverized fossil fuel and air in a controlled, turbulent flow. The fuel pipe for the burner nozzle has a relatively small diameter so that a relatively small amount of primary air is sufficient to carry the fuel to the burner nozzle. An atomizer is fitted to the outlet of the fuel pipe for introducing atomizing air in a generally tangential direction relative to the axial flow of the fuel. The air creates turbulence to swirl the fuel and distribute it in a controlled manner to provide for even burning of the fuel in the combustion zone. A pipe of smaller diameter may be concentrically positioned within the fuel pipe so that alternative fuels, such as gas and oil, may also be efficiently used with the burner nozzle.

10 Claims, 8 Drawing Figures

BURNER NOZZLE

BACKGROUND OF THE INVENTION

This invention relates generally to fuel burners, and more specifically, to a fuel burner nozzle particularly adapted for burning pulverized fossil fuels or, alternatively, gaseous or liquid fuels.

A number of designs are presently available which provide for distribution of pulverized fossil fuel, such as coal, to the combustion zone of a furnace. In a great majority of these designs, a fuel-carrying conduit receives pulverized coal from an external source and is connected to a burner for distributing the fuel to the burner. Both the conduit and the burner are relatively large in diameter and include a device for creating turbulence to enable the pulverized fuel to be distributed in a controlled manner so that it will burn more evenly in the combustion zone.

Since the coal-fired burners described above are relatively large in diameter, a correspondingly large amount of primary air is required to deliver the fuel to the combustion zone, which tends to create combustion limitations, especially under conditions calling for low furnace load. These combustion limitations result in poor control of fuel burning, possible increases in the production of air pollutants, and reduced thermal efficiency.

Also, coal-fired burners presently in use have a physical construction which is cumbersome and expensive to fabricate since their diameters can range from about one foot to over two feet, and are more or less fixed in position. Due to the size, adjustments are very limited, and in most cases none is possible once the apparatus is installed. Furthermore, repairs requiring removal of the burner are difficult to accomplish for the same reason.

On the other hand, gas and oil-fired burners have relatively small fuel lines and atomizers which are relatively easy to adjust, both in the positioning within openings in the boiler walls and in the fuel flow regulation under different load conditions. For example, gas and oil-fired burners can be controlled to provide sufficient fuel for as low as about 20–25% full burner load rating, whereas coal-fired burners have less flexibility and may only be decreased to about 40–50% of full load before the burner must be removed from service.

Currently available coal burners generally have been designed and sized to burn pulverized coal. Therefore, if it becomes desirable or necessary to burn alternative types of fuel, such as gas or oil, it becomes an expensive and time consuming procedure to convert the burners from coal to oil or gas. Conversely if the burners are designed for gas or oil and these types of fuels are not available, then to convert the burners to coal fuel again would also be an expensive and time consuming process.

SUMMARY OF THE INVENTION

It is therefore an object of the present invention to eliminate some of the problems normally associated with coal-fired burners and, more particularly to provide a coal-fired burner having characteristics which approach those of gas and oil-fired burners.

Another object of the present invention is to provide a burner nozzle for a coal burner which requires less primary air to conduct the fuel to the burner and thus provide for a cleaner combustion of the fuel with less formation of noxious gases resulting from the combustion.

Yet another object of the present invention is to provide a burner nozzle which is compatible with the burning of different types of fuel, such as coal, gas, and oil.

Toward the fulfillment of these and other objects the burner nozzle of the present invention is designed to feed the combustion zone of a vapor generator with a mixture of pulverized fuel and air in a controlled, turbulent flow. The burner nozzle is provided with a conduit having an inlet for receiving the fuel and an outlet communicating with the combustion zone. The conduit has a relatively small cross-sectional area so that only a relatively small amount of primary air is necessary to carry the fuel axially through the nozzle. An atomizing means is fitted to the outlet of the conduit for introducing a controlled stream of air in a generally tangential direction relative to the axial flow of the fuel for creating turbulence so as to swirl the fuel and distribute it in a controlled manner. The energy of the atomizing air creates the necessary turbulence to provide for even burning of the fuel in the combustion zone. A conduit of somewhat smaller size may be positioned concentrically within the fuel conduit of the burner nozzle to provide the capability of carrying gas or oil fuel to the burner nozzle, with the atomizing means being totally compatible with these alternative fuels.

In one embodiment, the atomizing means is formed by a housing concentrically positioned on the outlet of the fuel conduit and having a surface provided with a plurality of openings which direct the atomizing air in a generally tangential direction relative to the axial fuel flow. In another embodiment, the tangential flow of atomizing air is achieved by a plurality of radial vanes provided on a surface of a housing concentrically disposed about the outlet of the fuel conduit, with the vanes directing the atomizing air in a generally tangential direction relative to the axial fuel flow.

BRIEF DESCRIPTION OF THE DRAWINGS

The above description, as well as further objects, features, and advantages of the present invention, will be more fully appreciated by reference to the following description of presently preferred but nonetheless illustrative embodiments in accordance with the present invention, when taken in connection with the accompanying drawings, wherein.

DESCRIPTION OF THE PREFERRED EMBODIMENTS

Figure 1:
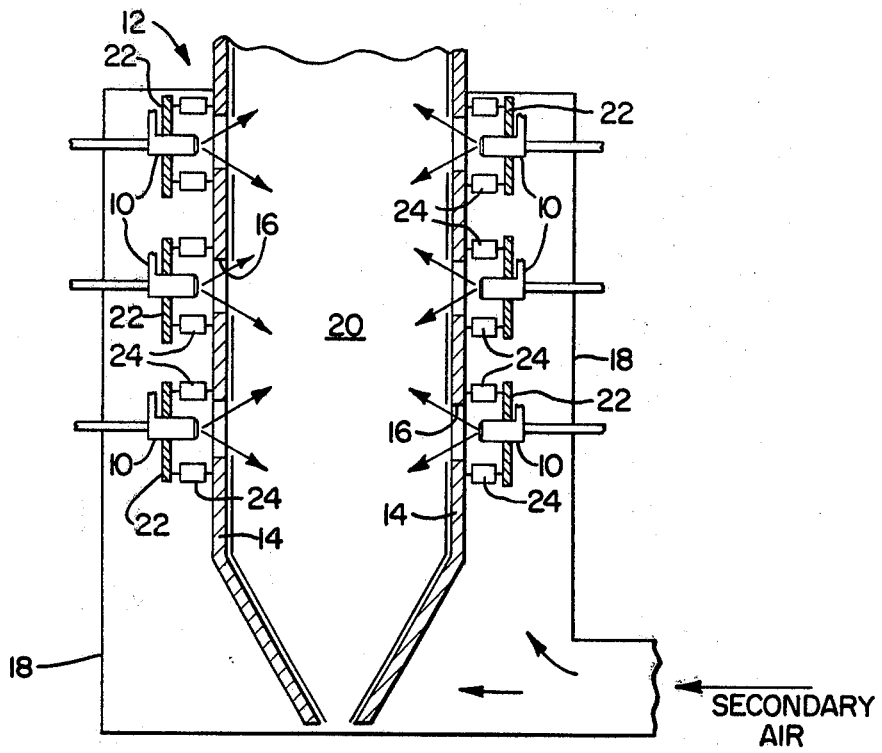
FIG. 1 is a partial, elevational view of a vapor generator with its boiler and register walls shown in cross section and including a plurality of burner nozzles of the present invention.

Referring now to the drawings, and more particularly to FIG. 1 thereof, the reference numeral 10 refers in general to the burner nozzle of the present invention, of which a plurality are shown installed in a boiler section 12 of a vapor generator. The boiler section 12 has wall sections 14, each of which are provided with a plurality of openings 16 extending therethrough. The burner nozzles 10 are mounted within a windbox 18, which encloses the lower portion of the boiler section 12, and discharge through the openings 16 into a combustion zone 20 within the interior of the boilder section 12, as indicated by the flow arrows emanating from the burner nozzles. Each burner nozzle 10 is provided with a register 22 having a pair of dampers 24 for regulating the flow of secondary air to the interior of the boiler 12 in a conventional manner. While only two dampers 24 are shown for each register 22, it is understood that the necessary number of dampers will be provided to achieve the necessary flow regulation of secondary air.

Figure 2:
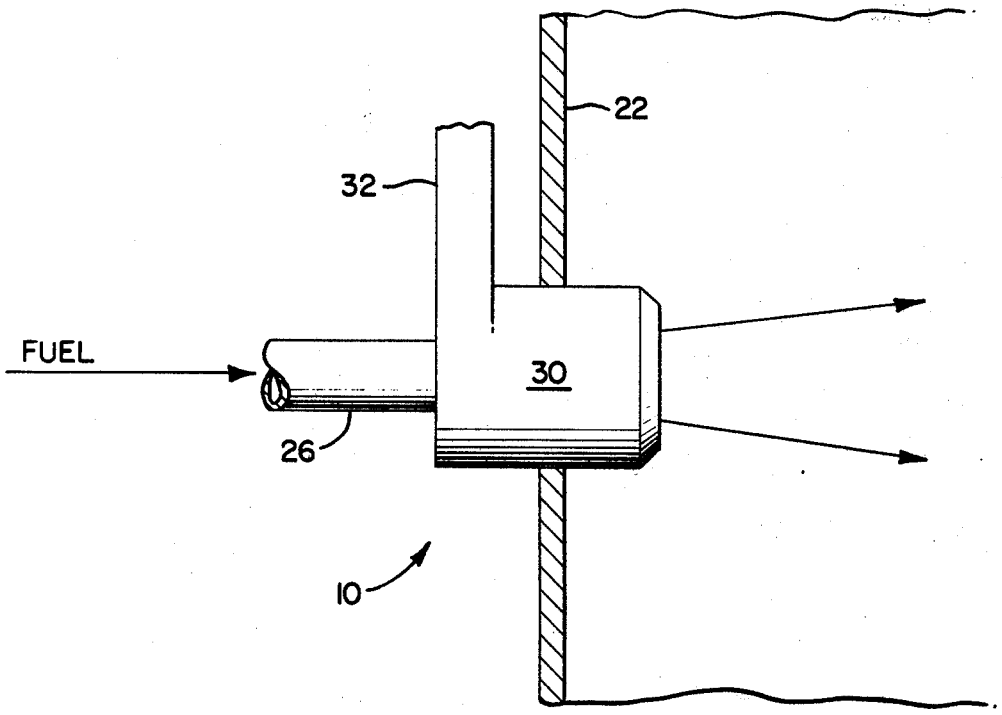
FIG. 2 is an enlarged, elevational view, partially sectioned, depicting in particular one of the burner nozzles of FIG. 1.

One of the burner nozzles 10 of FIG. 1 is shown to an enlarged scale in FIG. 2 extending through an opening provided in the wall of the register 22, and includes a fuel pipe 26 and an atomizer 30. The fuel pipe 26 supplies pulverized coal from a conventional source (not shown), with the pipe being appropriately sized to carry the pulverized coal mixed with a minimum quantity of primary air necessary to provide the transport fluid. The atomizer 30 is affixed to the outlet end portion of the fuel pipe 26, and an atomizing fluid, such as controlled, pressurized air, is supplied to the atomizer through the air line 32 to spray the pulverized coal from the burner nozzle 10 and into the combustion zone 20.

Figure 3:
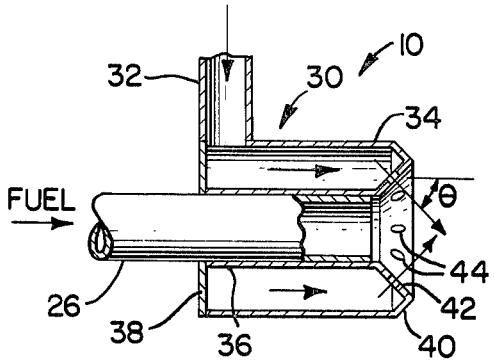
FIGS. 3 and 4 are a cross-sectional view and a frontal end view, respectively, of the burner nozzle of FIG. 2.

The structure of the burner nozzle 10 is shown more fully in FIG. 3, wherein the atomizer 30 includes an outer, cylindrical wall 34 which concentrically surrounds an inner, cylindrical wall 36 of somewhat smaller diameter. A disc 38 joins the rear end portions of the inner and outer cylindrical walls 36 and 34, respectively, with the disc being centrally perforated to permit insertion of the fuel pipe 26 into the inner wall where it extends in a closely spaced relation to the forward edge of the inner wall. The line 32 supplying air to the atomizer 30 intersects the outer wall 34 near its rear end, substantially in alignment with the anular disc 38. A plate 40, having a substantially V-shaped configuration, with the apex defining the forward tip of the atomizer 30, joins the forward edges of the walls 34 and 36 to enclose the space between these walls and, in cooperation with the disc 38, defines an enclosed volume.

Figure 4:
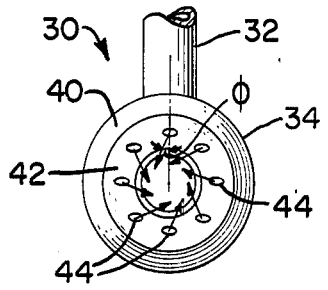

A surface 42 of the plate 40 connected to the inner cylindrical wall 36 and extending at an angle thereto is provided with a plurality of through openings 44 circumferentially spaced on the surface and radially disposed about the outlet of the fuel pipe 26. As shown in both FIGS. 3 and 4, the openings 44 may be in the form of cylindrical bores in the surface 42 and may be angled relative to two specific orientations, as described more fully below, so that the jets of atomizing air pass through the openings 44 in a generally tangential direction relative to the axial flow of the fuel from the pipe 26, as indicated in FIG. 4 by the directional arrows emanating from the plurality of openings. The jets of air thus pass across the outlet of the fuel pipe 26 and to the combustion zone 20 (FIG. 1).

Variations of the angular orientation of the openings 44 may be provided for different applications. As shown in FIG. 3, the central axis of each of the openings 44 intersects the central, longitudinal axis of the fuel pipe 26 at an angle of $\theta$. The central axis of each opening 44 also forms an angle of $\phi$ with respect to a line perpendicular to the central axis of the fuel pipe 26, as shown in FIG. 4. The angle $\theta$ establishes the point of intersection of one velocity component of the atomizing air with the axially-flowing fuel, and the angle $\phi$ establishes the tangential orientation of another velocity component of the atomizing air with respect to the fuel flow so that the jets of atomizing air are directed by the atomizer 30 to form a generally conical pattern in a helical flow path.

By way of illustrative example only, the plate 40 of the atomizer 30 may be fabricated by precision casting, with the openings 44 formed therein, and then suitably attached to the walls 34 and 36 of the atomizer, such as by welding. Alternatively, the plate 40 may be fabricated with the openings subsequently drilled therein.

The size of the openings 44, their arrangement on the surface 42 of the plate 40, such as in a circular row, the number of openings, such as two or more circular rows, and the spacing of the openings and of the rows depend upon the total atomizing flow energy required, a function of both the quantity and pressure of the atomizing air or other atomizing fluid, which in turn is dependent upon the fuel flow area of the fuel pipe 26.

In operation, pulverized coal and a small quantity of primary air is conducted through the fuel pipe 26 into the atomizer 30. Simultaneously therewith, atomizing air is introduced into the atomizer 30 through the air pipe 32 into the volume between the walls 34 and 36 of the atomizer, and is subsequently discharged through the openings 44 in a generally tangential direction relative to the axial flow of the pulverized coal and primary air. This tangential flow of atomizing air mixes with the pulverized coal and primary air and imparts a swirling motion to the overall mixture to create a controlled, turbulent flow. As a result, the mixture of fuel and air discharging from the burner nozzle 10 is quite rich, and reductions in fuel for decreasing load conditions do not effect the flow and burning characteristics of the mixture as radically as with conventional systems which carry large amounts of primary air.

The term "atomize" has been used for convenience, and does not mean that the atomizing air reduces the size of the individual particles of pulverized coal. Instead, the pulverized coal is properly sized prior to introduction into the fuel pipe 26, and the atomizing air "sprays" the coal into the combustion zone 20. The orientation of the atomizing flow, as described above, determines the effectiveness of the spray pattern.

Figure 5:
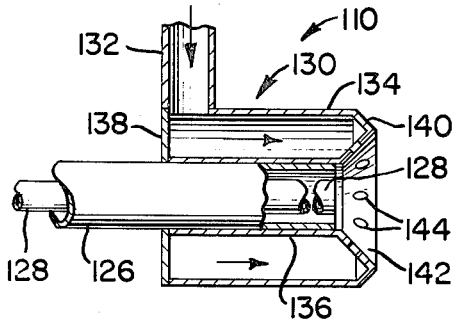
FIGS. 5 and 6 are views similar to FIGS. 3 and 4, but depicting another embodiment of the burner nozzle of the present invention.
Figure 6:
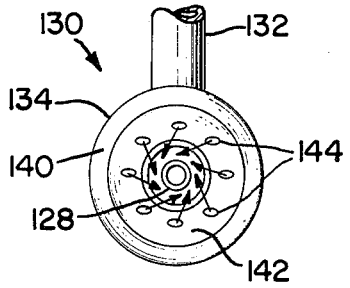

Shown in FIGS. 5 and 6 is an alternate embodiment of the burner nozzle of the present invention, in which corresponding parts have been designated by the same reference numerals as part of a "100" series. The alternate embodiment is configured for the burning of pulverized coal, but is readily convertible to the burning of other types of fuel, such as gas or oil. The burner nozzle 110 of FIGS. 5 and 6 is structurably similar to the nozzle 10 of FIGS. 3 and 4, except that concentric fuel pipes 126 and 128 are positioned within the inner, cylindrical wall 136. It is understood, of course, that the fuel pipe 126 of the burner nozzle 110 is appropriately sized to provide sufficient fuel-carrying volume and to accommodate the inner pipe 128, and that the dimension of the atomizer 130 would also be accordingly adjusted. In all other respects, the atomizer 130 of FIGS. 5 and 6 are the same as the atomizer 30 shown in FIGS. 3 and 4.

When the burner nozzle 110 is used for burning pulverized coal, the operation is the same as that of the nozzle 10, with the fuel and a small quantity of transporting primary air being provided to the atomizer 130 through the volume between the inner pipe 128 and the fuel pipe 126. In using the burner nozzle 110 with gaseous fuels, the fuel will also be supplied through the fuel pipe 126, and an ignitor (not shown) will be housed within the inner pipe 128 and be positioned adjacent to the outlet of the pipe. An orifice plate (not shown) of known construction may also be provided on the outside of and at the end of the atomizer 130 to divide the gas flow into a multiplicity of streams to enhance active mixing of the gas with the normal combustion air from the windbox 18. In using the burner nozzle 110 with liquid fuel, such as fuel oil, the fuel will be provided by an oil gun (not shown) through the inner pipe 128 positioned adjacent the outlet of the inner pipe. The oil is atomized in the gun and sprayed into the normal combustion air stream from the windbox 18. Ignition of the fuel oil is provided along the side of the atomizer 130. The ignitor and orifice plate used with gaseous fuel, and the gun used with liquid fuel are known in the art, and need not be discussed in detail.

Figure 7:
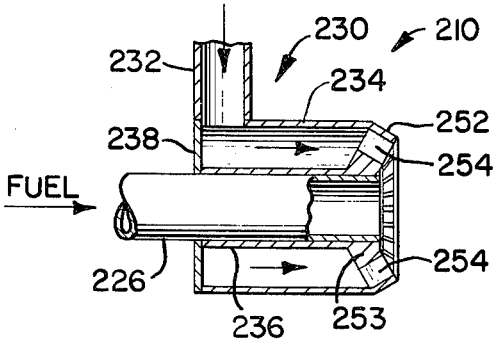
FIGS. 7 and 8 are a cross-sectional view and a frontal end view, respectively, of yet another embodiment of the burner nozzle of the present invention.
Figure 8:
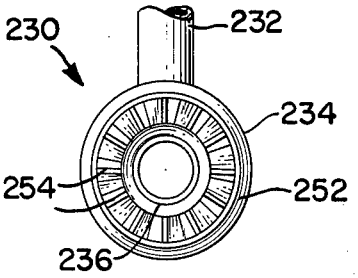

Another embodiment of the burner nozzle of the present invention is shown in FIGS. 7 and 8, wherein corresponding parts have been designated by the same reference numerals as part of a "200" series. The atomizer 230 of the nozzle 210 has an outer cylindrical wall 234 concentrically positioned about an inner cylindrical wall 236, which is sized to receive the outlet portion of the fuel portion of the fuel pipe 226. The rear edges of the cylindrical walls 234 and 236 are connected by an annular disc 238 having a central perforation through which the fuel pipe 226 extends. The forward edge of the outer wall 234 is provided with an inwardly-directed, directed, conical lip 252 and the forward edge of the inner wall is provided with an annular ridge 253 on its outer circumference. A plurality of vanes 254 are joined at their ends to the lip 252 and the ridge 253, with each vane positioned at an angle relative to a radial line extending between the lip and the ridge. Each of the vanes 254 is positioned to deflect the atomizing air from the chamber between the cylindrical walls 234 and 236 in a manner such that a velocity component is directed radially toward pipe 226 and another velocity component is directed in a substantially tangential direction relative to the axial flow of the fuel from the pipe, substantially similar to the functioning of the openings 44 and 144 described above. The radial flow component contributes to the break-up of the axial fuel flow while the tangential flow component imparts a swirling motion to the mixture of fuel and atomizing air and results in a controlled, turbulent flow similar to that described above relative to FIGS. 3-6.

In operation, the burner nozzle 210 functions in the same manner as the nozzle 10 illustrated in the embodiment of FIGS. 3 and 4, with the vanes 254 controlling the flow of atomizing air.

While not specifically illustrated, it is understood that the concentric fuel pipe arrangement shown in FIGS. 5 and 6 can be incorporated with an atomizer structure utilizing vanes similar to 254 described in connection with the atomizer 230. The operation of this configuration is apparent from the foregoing descriptions of the embodiments of FIGS. 5-6 and 7-8.

The atomizer 230 may also be fabricated by precision casting, with the vanes 254 integrally formed between and joining the conical lip 252 and the annular ridge 253, or the vanes may be subsequently attached to these structural elements, as by welding, in a turbine-like arrangement. The size, number, and orientation of the vanes are determined by the same considerations as discussed above relative to the openings 44 and 144.

The atomizing fluid and the primary carrier fluid may be air, steam, flue gases, or any convenient, available fluid. Mixtures, of course, are possible, depending on the application requirements. While the atomizers have been described as separate structures concentric with the fuel pipes and comprising a cylindrical wall within a cylindrical wall, it may be constructed as an integral structure affixed to the fuel pipes, with the inner cylindrical wall serving as the outlet portion of the fuel pipe.

The burner nozzles of the present invention obviate the necessity of utilizing a large or excessive volume of primary air to carry fuel to the burner nozzles, and consequently reduce the size of each nozzle such that the coal-burning nozzles are comparable with the size of gas and oil-fired burner nozzles. For example, in the single fuel pipe configurations the fuel pipe 26 or 226 may have an inner diameter as small as 4 to 6 inches. In the alternatefuel, concentric-pipe configurations, the inner diameter of the fuel pipe 126 may be about 6 inches, while the outer diameter of the inner pipe 128 will be about 4 inches, leaving a 2-inch annular space between these two pipes for carrying pulverized coal.

In the present invention, it is contemplated that a pulverizing mill (not shown) will provide fuel in a pulverized form to the fuel pipes 26, 126 or 226. However, the mill outlet would be vented to divert some of the primary air or other fluid carrying the fuel once the fuel has been pulverized. This diverted air may be vented to the vapor generator for use in burning entrained particles and also for supplying the stoichiometric combustion air requirements, such that once combustion is started in the combustion zone 20 the air diverted from the pulverizing mill will complete the burning of the fuel.

For a given design of a nozzle, the primary control of the pressure of the atomizing air flow provides regulation of the shape of the fuel stream to optimize the fuel burning conditions. The atomizing air flow pattern may be changed to achieve lean or rich combustion conditions to satisfy the operational requirements. Adjustment of the atomizing air flow can be used to improve stability turndown, that is, the maintenance of stable combustion at different fuel flow levels, resulting in flame conditions which can contribute to reductions in both the thermal formation of nitrous oxide ($NO_x$) and the conversion of fuel-bound nitrogen to $NO_x$. The ability to vary the fuel can lead to reductions in excess air requirements, which also tend to decrease the production of pollutants, such as oxides of nitrogen and sulfur trioxide, and to a decrease in the stack heat loss. Decreases in the production of pollutants, of course, reduces the deleterious effects on the environment, and the reduction of stack heat losses increases the thermal efficiency, with consequent decreases in fuel consumption.

Normally, burner flame adjustments are made by secondary air damper changes, and even with oil or gas firing, fuel input patterns are limited except by hardware changes. With the burner nozzle described herein, fuel input patterns can be varied with the burner in operation and the secondary air control is still available to further optimize the flame.

The present invention, therefore, provides a system for controlling the flow pattern of pulverized fuel in a burner nozzle, with attendant beneficial effects of reducing the production of noxious gases, reducing the size of burner nozzles, and reducing the cost of attendant production and installation. These benefits will encourage the use of coal, which of late has become a more attractive fuel in view of the rising cost of other available fuels. The arrangement of a fuel pipe for pulverized coal and a fuel pipe for alternate fuels provides a versatility in the presently-disclosed burner nozzle which has not been available heretofore, and provides the flexibility of adaptation to the type of fuel which is more economic and most readily available.

Although not particularly illustrated in the drawings, it is understood that the air pressure in the line connected to the atomizer may be regulated in order to compensate for changing loads and desired flow patterns as required. For example, a stronger atomizing air pressure may be required if a particularly rich mixture of fuel is utilized under heavy load conditions. Further, it is understood that all of the components described above are arranged and supported in an appropriate fashion to form complete, operative systems.

Of course variations of the specific construction and arrangement of the burner nozzles disclosed above can be made by those skilled in the art without departing from the invention as defined in the appended claims.

I claim:

1. A burner nozzle comprising:

a housing having inner and outer concentric, cylindrical walls defining a volume between the walls;

a fuel conduit having an outlet portion extending into said inner cylindrical wall for axially discharging fuel from said housing;

an annular member joining one end portion of said inner and said outer cylindrical walls and forming a closure wall for said volume between said walls, said member having an aperture through which said fuel conduit passes;

means for supplying an atomizing fluid to the volume between said cylindrical walls; and means for discharging said atomizing fluid in a direction substantially tangential to the fuel discharging axially from said fuel conduit, said fluid imparting a swirl to the fuel to distribute the fuel in a controlled manner to provide for even burning of the fuel.

2. The burner nozzle of claim 1 wherein said means for supplying an atomizing fluid includes a fluid conduit disposed on said outer wall for introducing the fluid into the volume of said housing.

3. The burner nozzle of claim 1 wherein said means for discharging the atomizing fluid includes an inclined surface joining one end portion of said inner and outer cylindrical walls, said surface having a plurality of orifices disposed circumferentially about the outlet of said fuel conduit, each of said plurality of orifices being positioned to direct a component of the atomizing fluid flow radially inward toward the fuel flow and a component of the atomizing fluid flow substantially tangential to the fuel flow.

4. The burner nozzle of claim 1 wherein said fuel conduit comprises inner and outer concentric fuel pipes, each of said pipes having a portion extending into said inner cylindrical wall.

5. The burner nozzle of claim 4 wherein the outer, concentric fuel pipe is adapted to discharge a pulverized, solid fuel from said housing.

6. The burner nozzle of claim 4 wherein the outer, concentric fuel pipe is adapted to discharge a gaseous fuel from said housing.

7. The burner nozzle of claim 4 wherein the inner, concentric fuel pipe is adapted to discharge a liquid fuel from said housing.

8. The burner nozzle of claim 3 wherein said fuel conduit comprises inner and outer concentric fuel pipes, each of said pipes having a portion extending into said inner cylindrical wall.

9. The burner nozzle of claim 1 wherein said means for discharging the atomizing fluid includes a plurality of vane members joining one end portion of said inner and outer cylindrical walls, said vane members being disposed circumferentially about the outlet of said fuel conduit, each of said plurality of vane members being positioned to direct a component of the atomizing fluid flow radially inward toward the fuel flow and a component of the atomizing fluid flow substantially tangential to the fuel flow.

10. The burner nozzle of claim 9 wherein said fuel conduit comprises inner and outer concentric fuel pipes, each of said pipes having a portion extending into said inner cylindrical wall.

* * * * *